US010205230B2

(12) United States Patent
Desclos et al.

(10) Patent No.: US 10,205,230 B2
(45) Date of Patent: Feb. 12, 2019

(54) ANTENNA SYSTEM COUPLED TO AN EXTERNAL DEVICE

(71) Applicant: Ethertronics, Inc., San Diego, CA (US)

(72) Inventors: Laurent Desclos, San Diego, CA (US); Sebastian Rowson, San Diego, CA (US); Jeffrey Shamblin, San Marcos, CA (US)

(73) Assignee: Ethertronics, Inc., San Diego, CA (US)

( * ) Notice: Subject to any disclaimer, the term of this patent is extended or adjusted under 35 U.S.C. 154(b) by 0 days.

(21) Appl. No.: 15/677,996

(22) Filed: Aug. 15, 2017

(65) Prior Publication Data

US 2018/0026359 A1 Jan. 25, 2018

Related U.S. Application Data

(63) Continuation of application No. 13/295,979, filed on Nov. 14, 2011, now abandoned.

(60) Provisional application No. 61/412,473, filed on Nov. 11, 2010.

(51) Int. Cl.

| | |
|---|---|
| ***H01Q 1/24*** | (2006.01) |
| ***H01Q 1/40*** | (2006.01) |
| ***H01Q 1/52*** | (2006.01) |

(52) U.S. Cl.

CPC ..... *H01Q 1/40* (2013.01); *H01Q 1/243* (2013.01); *H01Q 1/521* (2013.01)

(58) Field of Classification Search

CPC ..... H01Q 1/243; H01Q 1/521; H01Q 1/40

See application file for complete search history.

(56) References Cited

U.S. PATENT DOCUMENTS

| | | | | |
|---|---|---|---|---|
| 4,835,538 | A | 5/1989 | McKenna et al. | |
| 5,809,433 | A | 9/1998 | Thompson et al. | |
| 6,198,441 | B1 * | 3/2001 | Okabe | H01Q 1/243 343/702 |
| 6,430,400 | B1 | 8/2002 | MacDonald, Jr. et al. | |
| 2004/0040734 | A1 | 3/2004 | Shiotsu et al. | |
| 2006/0197538 | A1 * | 9/2006 | Leinonen | H01Q 1/243 324/533 |
| 2008/0316120 | A1 | 12/2008 | Hirota et al. | |
| 2009/0058737 | A1 | 3/2009 | Tsujimura et al. | |
| 2010/0026589 | A1 | 2/2010 | Dou et al. | |
| 2011/0018771 | A1 | 1/2011 | Li et al. | |
| 2011/0090626 | A1 | 4/2011 | Hoellwarth et al. | |

(Continued)

*Primary Examiner* — Dieu H Duong
(74) *Attorney, Agent, or Firm* — Dority & Manning, P.A.

(57) ABSTRACT

An antenna system is integrated into a cover or accessory and adapted to couple to an antenna in a host device to improve transmission and reception of signals. The antenna system can be passive or active, with the active antenna system designed to amplify coupled signals on the integrated antenna elements in the cover or accessory. Single or multiple frequency bands can be improved with the integrated antenna system, and multiple antennas in the host device can be coupled to and improved. The antenna system can couple to the existing antennas in the host device by capacitive coupling, i.e. no physical contact required, or a connector can be designed into the cover or accessory containing the integrated antenna system that makes contact to electrical ground of the host device or power supply signals or other control signals.

18 Claims, 6 Drawing Sheets

(56) References Cited

U.S. PATENT DOCUMENTS

| | | | |
|---|---|---|---|
| 2011/0287726 | A1 | 11/2011 | Huang |
| 2012/0071214 | A1 | 3/2012 | Ash, Jr. et al. |

* cited by examiner

ANTENNA SYSTEM COUPLED TO AN EXTERNAL DEVICE

CROSS-REFERENCE TO RELATED APPLICATIONS

This application is a continuation of U.S. Ser. No. 13/295,979, filed Nov. 14, 2011, titled "ANTENNA SYSTEM COUPLED TO AN EXTERNAL DEVICE";

which claims benefit of priority to U.S. Provisional Application Ser. No. 61/412,473, filed Nov. 11, 2010, titled "ANTENNA SYSTEM COUPLED TO AN EXTERNAL DEVICE";

the entire contents of each of which are hereby incorporated by reference.

FIELD OF THE INVENTION

This invention relates to antennas for use in wireless communication devices; and more particularly to antennas and radiating structures integrated within a handset cover or case accessory to enhance the performance of antennas in the host wireless communication device.

BACKGROUND OF THE INVENTION

A multitude of wireless communications devices including cellular phones, personal media devices, tablet pc's, and laptops are widely used and commercially available. These devices continue to become increasingly popular as demand for improved devices continues to grow. As market trends move towards smaller devices in an effort to enhance portability, device components are collaterally constrained to meet design specifications. At the same time, consumers are demanding a multitude of applications for use with wireless devices such as TV and FM radio reception and internet connectivity. As trends in consumer demands move towards multi-application portable electronic devices, component manufacturers are required to meet new requirements, and therefore develop novel solutions to satisfy consumer demands. Because portability is an ongoing necessity in the portable electronics market, size constraints must remain a primary focus of component manufactures. Cell phones, for example, are becoming smaller in size and lighter in weight while providing an increased number of useable features, such as internet, radio, television (DVB-H), communications, and others. To meet the demand for multi-application cell phones, additional and/or larger antennas and other components are often required. Cell phone and other portable electronic device manufacturers are moving towards reducing size of components and unnecessary bulk space, and reusing space where possible and practical. Antennas, specifically, have been a major focus of reducing size and space in electronic wireless communications devices. Multiple electrically small antennas embedded in a small wireless device will tend to couple, thereby degrading performance. Additionally, with the arrival of 4G communication systems, additional frequency bandwidth is required from the main antenna in a wireless device, along with a second antenna to satisfy the MIMO (Multiple Input Multiple Output) antenna requirement.

Current market-available antenna designs and prior art antennas are not suitable for overcoming the aforementioned problems. Taking into consideration the requirements for the next generation of devices along with the deficits of current technologies, a solution is needed which achieves efficiency from an antenna required to cover the large frequency bands.

Antennas commonly known and available which generally cover the whole frequency range tend to display inadequate antenna radiation efficiency at a fixed volume.

There is further a current need for improved connectivity at cellular and data transmission bands for mobile devices to accommodate the increasing demand for data rates for mobile wireless systems. Improved antenna performance, such as increased efficiency, will translate into increased data rates. Methods for increasing antenna system performance in wireless devices without increasing antenna volume requirements in the host device are welcomed and in fact desired in the industry to improve overall mobile system performance.

A trend in the consumer wireless industry is for a growing number of Original Equipment manufacturers (OEMs) and Original Design Manufacturers (ODMs) to develop and market their own wireless device with the device designed to meet the minimum over-the-air performance required by carriers. These requirements sometimes do not take into account some specific user cases and situations that might degrade proper functionality of the antenna. Some solutions are needed to enhance the connectivity in any of the bands. Either cellular or media antennas could benefit from a supplementary antenna acting as a type of repeater in a surrounding case.

It would be beneficial to provide a case with integrated conductors designed to couple to and aid antenna performance, including a multi-conductor system designed to improve performance of a multiband communication system. In addition to the integrated conductors, features such as solar cells for battery recharging along with additional batteries can be included in the case assembly.

SUMMARY OF THE INVENTION

Accordingly, it is an object of the present invention to solve these and other problems in the art by providing an improved antenna structure that can be coupled to one or more antennas in a wireless communications device to enhance performance at the respective communication frequency bands, without adding bulk space to the associated device. It is another objective to provide passive and or active antenna structures integrated into a cover, such as the current cell phone covers sold to protect a cell phone from damage and as a cosmetic enhancement. It is another goal of the various embodiments of the present invention to provide an enhanced antenna system which couples to existing antennas designed into or external to a mobile wireless device, such as antennas designed for GPS, Wifi, FM and VHF and UHF TV reception, to improve reception/transmission of signals without requiring any volume within the portable wireless device. The antenna system must further operate without interference with the main antenna or other wireless components of the portable wireless device.

In keeping with these objectives and with others which will become apparent hereinafter, an antenna is provided, wherein the antenna is located externally to the wireless device. The antenna system may further include one or more active components for actively tuning or amplifying the signal to or from the several internal antennas of the mobile device. The one or more active components and the antenna may further be located within a plastic housing that is external to the wireless device. In a general embodiment, an assembly includes an antenna element, a matching circuit, a connector, and a plastic housing. The connector provides a means to connect the antenna to the internal radios and/or receivers, or to electrical ground, and provides a means of mechanical attachment to the wireless device.

The assembly may further include a circuit board that contains one or more passive or active components to impedance match and dynamically tune an antenna. The antenna element can be a planar conductor, a wire or a coil. The antenna element can also be etched on the circuit board. The antenna element can also be printed or electroplated on the plastic cover.

In another embodiment, an active tunable antenna having an antenna element and an active tuning circuit is integrated into the plastic housing, with the plastic housing attached to the wireless device using a connector. The connector will provide a positive contact terminal and negative contact terminal for supplying power to the portable electronic device, a feed contact terminal for driving the antenna, and a ground contact terminal for connecting the antenna to ground.

In another embodiment, the assembly includes multiple layers on the outer or inner surface of the plastic housing. Each layer can include one or more portions of an antenna, thereby providing a multi-layer antenna assembly. For example, an antenna element can be attached to the outer layer while feed lines and distributed matching elements, such as transmission line elements, can be attached to inner layers. The multiple conductive layers used to form the antenna element and feed lines can be separated by non-conductive layers. The non-conductive layers can be formed from polymer, fiber, paper, or ferrite materials. Moreover, distinct layers can provide permittivity and permeability factors designed to enhance antenna performance.

In another embodiment, an antenna element and connector along with passive or active matching components are embedded into a plastic or rubber cell phone cover. The plastic or rubber cell phone cover is typically used to protect the cell phone from damage.

In another embodiment, antenna or conductor is embedded into a cover and is designed to couple or connect to a metal housing or other conductive feature on the host wireless device.

In another embodiment, an antenna along with a receiver or transceiver is integrated into the cover, with connection made between the cover and host device to provide power and control signals. The resulting device provides multiple uses, such as a cover to protect and decorate the host device, as well as provide a receive or transceiver system to transmit and/or receive signals independent of the host device.

Other aspects and features of the present invention will become apparent to those having ordinary skill in the art upon review of the following description of specific embodiments of the invention in conjunction with the accompanying figures. It is to be understood that both the foregoing general description and the following detailed description are exemplary and explanatory only and are not restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

These and other attributes of the invention are further described in the following detailed description, particularly when reviewed in conjunction with the drawings, wherein.

DETAILED DESCRIPTION OF THE PREFERRED EMBODIMENTS

Figure 1A:
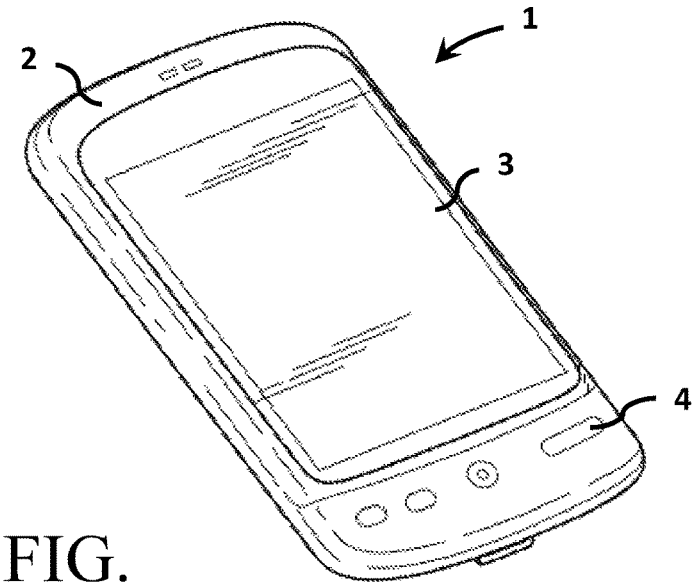
FIG. 1a (Prior Art)
FIG. 1*a* illustrates a mobile wireless device having a display and keypad positioned on a front side of the device.

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions without departing from the spirit and scope of the invention. Certain embodiments will be described below with reference to the drawings wherein illustrative features are denoted by reference numerals.

In a general embodiment of the invention, a cover accessory such as a device case can be utilized to house one or more antenna system components; thereby reducing volume requirements within the portable electronic device itself, and further providing a means for improving signal reception and transmission. As mentioned above, certain portable electronic devices are currently manufactured to meet only minimum communication requirements; this problem is largely attributed to size requirements within portable electronic devices. Because consumers trend toward purchasing compact devices, device manufacturers often sacrifice performance components for aesthetic concerns such as device volume. Accordingly, many devices are not optimized for use, but rather for aesthetics. The invention provides a novel solution whereby one or more antenna components can be housed efficiently within a device cover accessory, or device case, such that signal enhancements are provided as an option to the device user.

In one embodiment, a portable electronic device includes at least one antenna radiating structure contained within the device housing. A device cover accessory is provided for use with the portable electronic device. The device cover generally includes a non-conductive article adapted to attach to, and conform about, at least half of the portable wireless device. The non-conductive article, such as a device case, can be fabricated from any combination of polymer (plastic), fiber, paper, or ferrite materials. The non-conductive article includes at least one antenna component, such as a conductive element, active component, or other antenna component.

In one embodiment, one or more conductive elements are embedded within the device cover accessory. Here, the one or more conductive elements can be positioned near an internal antenna of the portable wireless device and adapted for coupling therewith. In this regard, the antenna can be optimized and performance enhanced. The conductive elements can be positioned within a common layer of the device cover. Alternatively, each of the one or more conductive elements can be embedded within separated layers of the cover accessory. In this regard, the conductive portions can be engineered for optimum placement within the device cover accessory.

In another embodiment, an antenna radiating element can be positioned within the cover assembly. In addition, the radiating element can be connected to an active component or transceiver. The active component or transceiver can be contained within the device cover accessory. Alternatively the active component, or transceiver, can be contained within the portable electronic device and connected to the radiating structure by a conductor wire and connection between a connector port of the device and a connector of the device cover.

In yet another embodiment, a first conductive element can be embedded within a device cover accessory and adapted for positioning near a first internal antenna of the portable wireless device, and a second conductive element can be embedded within the device cover accessory and adapted to be positioned adjacent to a second internal antenna of the portable wireless device. In this regard, two or more internal antennas can be separately optimized for performance utilizing components embedded within a device cover accessory, or device case.

For purposes of this invention, the term "internal antenna" is used herein to describe an antenna contained within a portable electronic device. Internal antennas generally include a main cellular communication antenna, an FM antenna, or other driven antenna contained within the housing of a portable device.

For purposes of this invention, the term "active component" is used herein to describe a component which actively interacts with antenna circuitry and componentry, including at least: switches, variable capacitors, diodes, and the like.

For purposes of this invention, the term "conductive element" is used herein to describe a conductive wire, planar conductor, or other elongated conductive member adapted to electrically or capacitively couple to an antenna radiating member.

Figure 1B:
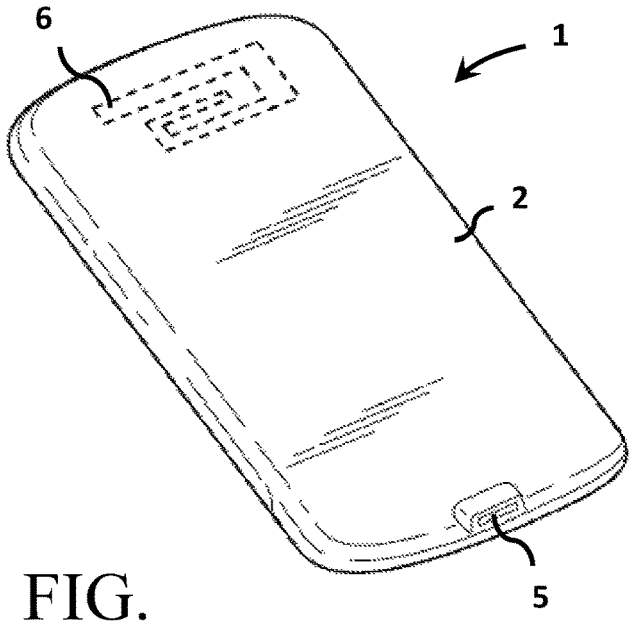
FIG. 1b (Prior Art)
FIG. 1*b* illustrates a rear view of the mobile wireless device of FIG. 1, with the rear view showing the location of an internal antenna with a series of dashed lines.

Now turning to the figures, certain illustrative embodiments are provided for further description of the inventive features. FIG. 1*a* illustrates a front side of a commonly available portable wireless device 1, i.e. a cellular phone. The portable device 1 includes a device housing 2 containing a screen 3 and a number of buttons 4. FIG. 1*b* further illustrates the portable device 1 from a rear-view perspective; the portable device 1 further includes a rear portion of the device housing 2, a connector port 5, and an antenna 6 contained within the portable device housing 2. As can be observed, the portable electronic device includes an internal antenna 6 positioned near a first side of the portable electronic device.

One having skill in the art will recognize that this invention, although particularly useful with cellular phones, can further be utilized with any portable electronic device having a need for communication over a network connection, for example an iPod, iPad, wireless internet browsing device, or other internet or communications related device. Although a cellular phone is provided herein in several embodiments for illustrative purposes, one having skill in the art would recognize that any portable communications device can be utilized with the invention without departing from the spirit and scope of the invention.

Figure 2A:
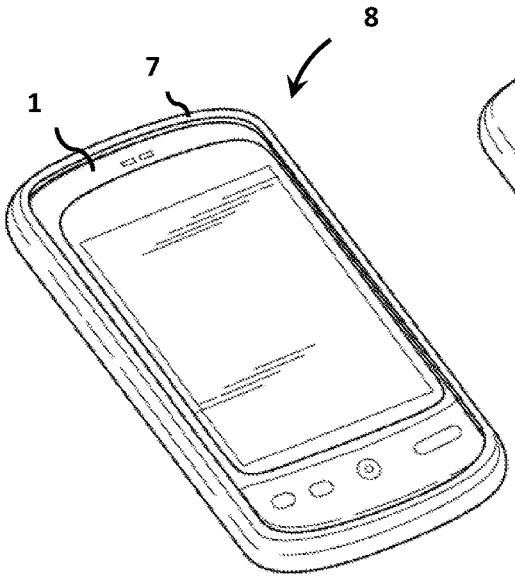
FIG. 2*a* illustrates an example of a cover placed on a mobile wireless device as illustrated from a front view.
Figure 2B:
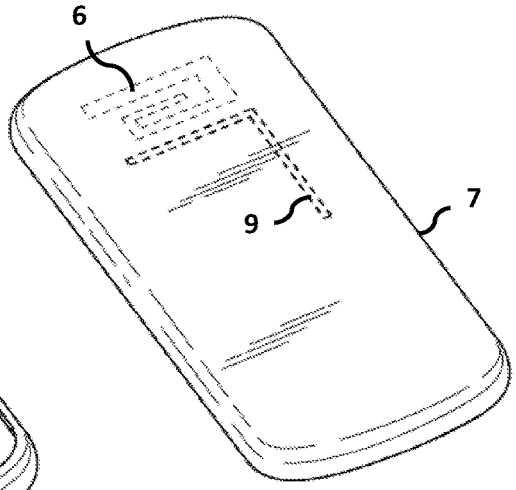
FIG. 2*b* illustrates a rear view of the mobile wireless device and cover according to FIG. 2*a*; the rear portion of the case includes an embedded conductive element adapted for positioning near the embedded antenna of the host device.

FIG. 2*a* illustrates an example of a cover accessory 7 placed on a mobile wireless device 1 to form a covered device 8. FIG. 2*b* further illustrates a rear-view perspective of the covered device. The cover accessory is generally comprised of a dielectric shell material and one or more conductor elements integrated within the dielectric shell. The cover accessory 7 is adapted to substantially conform about at least half of the surface of the portable electronic device 1; the cover accessory 7 further comprises an embedded conductive element 9 adapted for positioning near the internal antenna 6 of the attached portable electronic device 1. When in use, the conductive element 9 is adapted to couple with the internal antenna 6 to provide optimized radiation characteristics and enhanced performance.

Figure 3A:
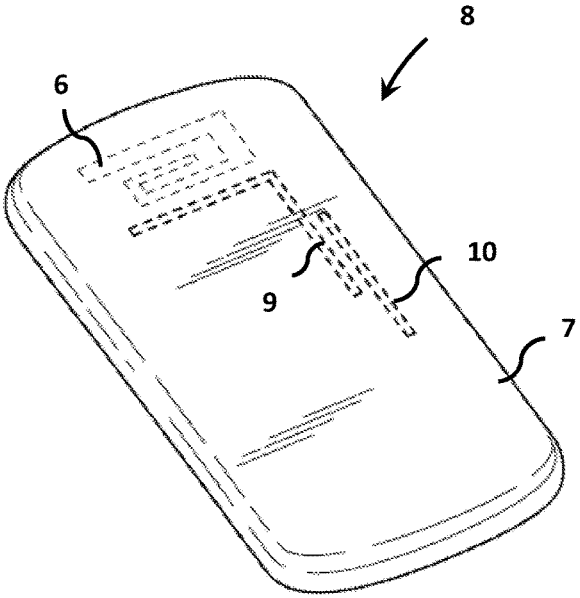
FIG. 3*a* illustrates another embodiment of the invention, wherein the cover accessory includes a first conductive element and a second adjacent conductive element each embedded within the cover accessory and adapted for positioning near a device antenna embedded within the portable wireless device.

In another embodiment, as illustrated by FIG. 3*a*, the covered portable electronic device 8 includes a cover accessory 7 attached to the portable electronic device; the cover accessory further comprises a first conductive element 9 and a second conductive element 10 positioned near the first conductive element 9. The first conductive element includes a first elongated portion and a second perpendicular portion extending outwardly perpendicular from a distal end of the elongated portion. The first and second conductive elements are positioned near a top portion of the portable electronic device and adapted to couple with an internal antenna 6. In this regard, a plurality of conductive elements can be embedded within a device cover accessory and adapted to couple with one or more internal antennas of a portable electronic device.

Figure 3B:
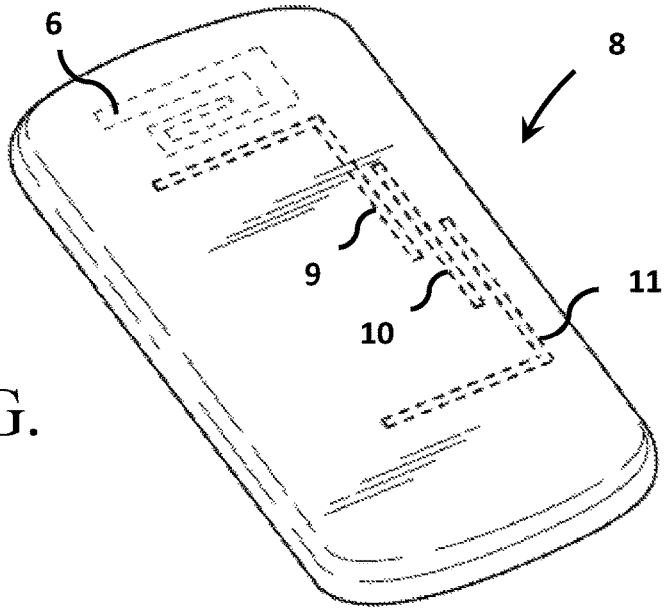
FIG. 3*b* illustrates yet another embodiment of the invention, wherein the cover accessory includes a first, second, and third conductive element embedded therein; each of the first through third conductive elements is adapted to couple with at least one device antenna.

In yet another embodiment, as illustrated by FIG. 3*b*, a device cover accessory can further comprise a third conductive element 11 embedded therein. The first through third conductive elements 9; 10; and 11, are each adapted to couple with an internal antenna of the portable electronic device.

Figure 4:
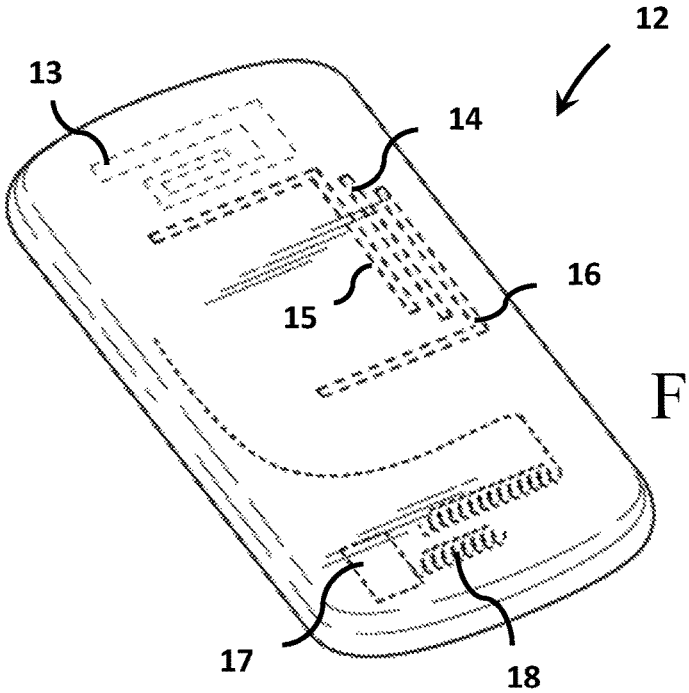
FIG. 4 illustrates an example of a mobile wireless device having two internal antennas, a main cellular antenna and an FM antenna for radio reception. Three conductive elements are integrated into a cover, with each conductive element coupled to at least one of the two antennas.

FIG. 4 illustrates an example of a mobile wireless device 12 having two internal antennas, a main cellular antenna 13 and an FM antenna 18 for radio reception. Three conductive elements 14, 15, and 16 are integrated into a cover 19, with each conductive element adapted to couple to at least one of the two antennas.

Figure 5:
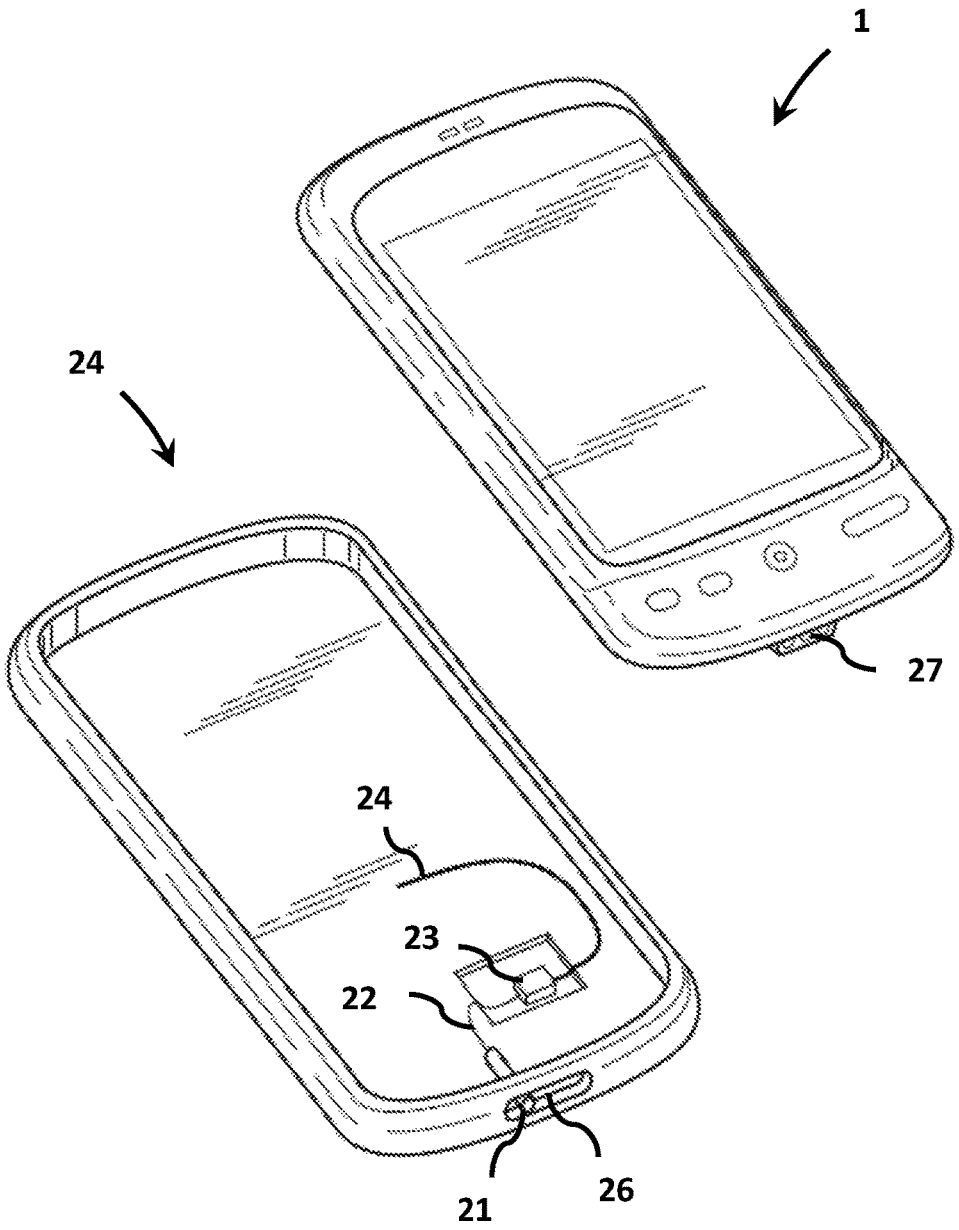
FIG. 5 illustrates an example of a mobile wireless device having a connector port located along the bottom side of the device. A cover accessory includes a connector, active component, and conductive element, with the connector positioned and sized to insert into the connector port of the mobile wireless device and provide power to the active device.

FIG. 5 illustrates an example of a mobile wireless device 1 comprising a connector port 27 located along the bottom side of the device. A cover 20 has a connector 26, active component 23, and conductive element 24, with the connector positioned and sized to insert into the connector port 27 of the mobile wireless device and provide power to the active device. A conductor wire 22 connects signals from connector 21 to active component 23.

Figure 6A:
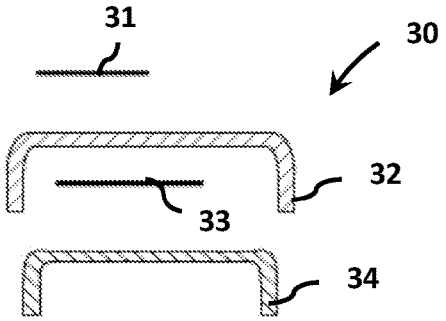
FIGS. 6(*a-b*) illustrate an example of a multi-layer cover accessory having conductive elements attached to individual non-conductive layers, resulting in a composite assembly with the conductive elements separated by non-conductive layers. One conductive layer is attached to the outer surface of the assembly and can be used as decorative feature.
Figure 6B:
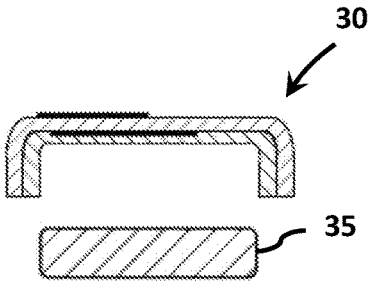

FIGS. 6(*a-b*) illustrate an example of multiple conductive elements separated by non-conductive layers to form a composite cover assembly. Conductive element 31 is attached to a non-conductive layer 32 with a second conductive element 33 attached to a second non-conductive layer 34. The assembled cover 30 can be attached to a wireless device 35. The resulting composite assembly provides a method of embedding two or more conductive elements in three dimensions to provide additional flexibility in coupling to the internal antennas in the wireless device that the composite cover is used with.

Figure 7A:
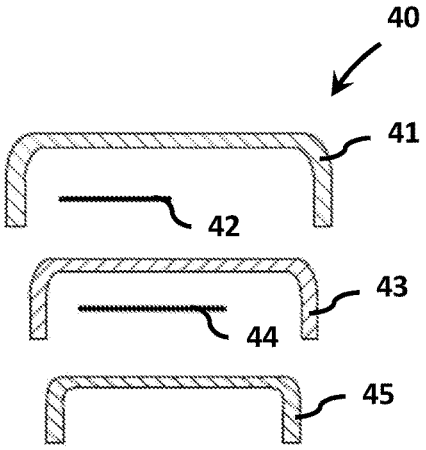
FIGS. 7(*a-b*) illustrate an example of a multi-layer cover accessory having conductive elements attached to individual non-conductive layers, resulting in a composite assembly with the conductive elements separated by non-conductive layers. Both conductive elements are embedded within the composite cover assembly.
Figure 7B:
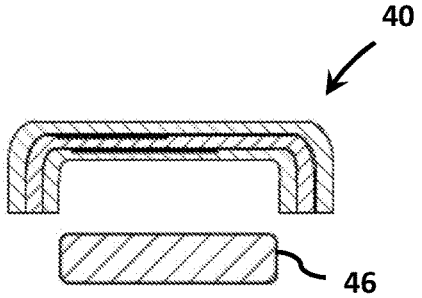

FIGS. 7(*a-b*) illustrate an example of multiple conductive elements separated by non-conductive layers to form a composite cover assembly. Conductive element 42 is positioned between two non-conductive layers 41 and 43. A second conductive element 46 attached to a third non-conductive layer 45. The assembled cover 40 can be attached to a wireless device 46. The resulting composite assembly provides a method of embedding two or more conductive elements in three dimensions to provide additional flexibility in coupling to the internal antennas in the wireless device that the composite cover is used with.

Figure 8:
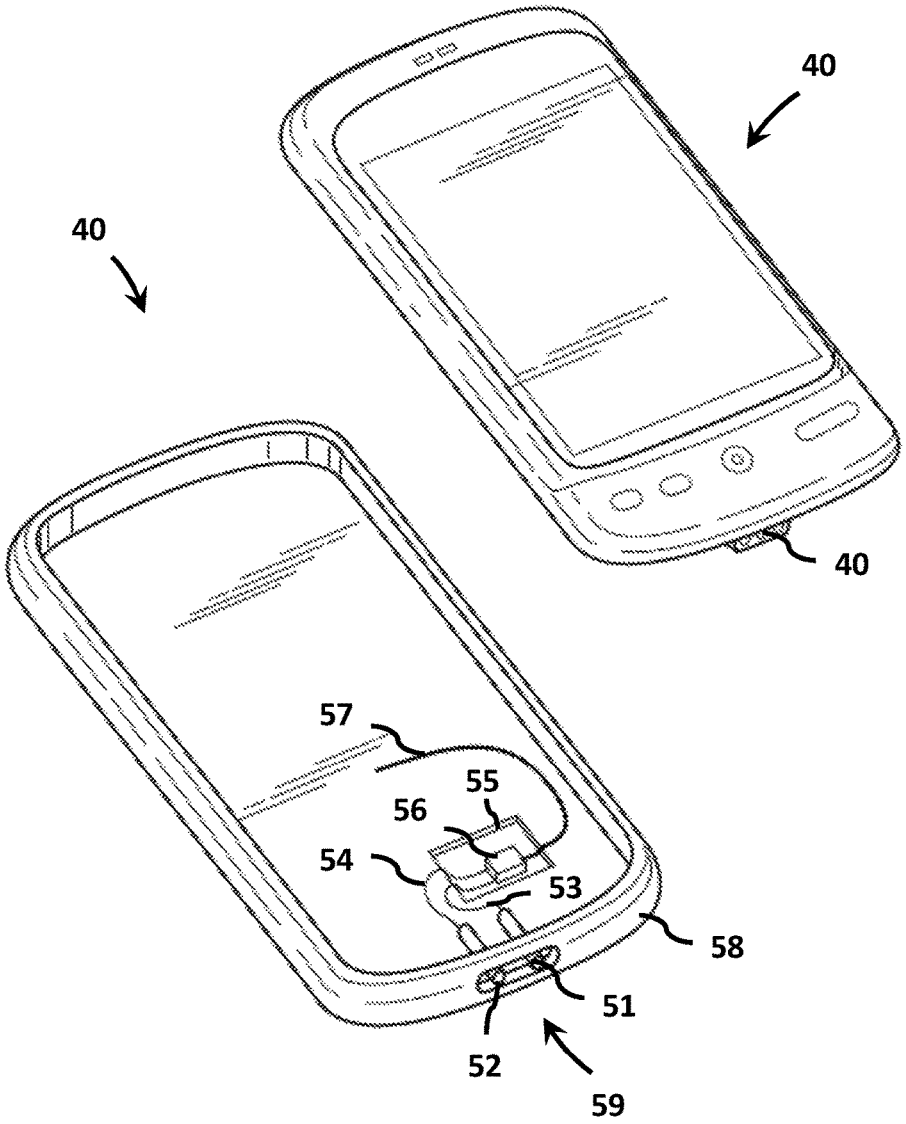
FIG. 8 illustrates an example of a cover accessory including a transceiver and conductive element integrated therein. Connections are designed into the cover to provide supply power and control signals to the transceiver from the host wireless device.

FIG. 8 illustrates an example of a mobile wireless device 1 which has a connector port 59 located along the bottom side of the device 1. A cover 50 has a connector 52 for supply power, and a connector 51 for transmission of signals. A receiver 56 and conductive element 57 are integrated into the cover housing 58. Conductors 54 and 53 provide supply power and signals from connectors 52 and 51 to receiver 56. The connector integrated into the cover is positioned and sized to insert into the connector assembly of the mobile wireless device and provide power to the active device.

The above examples are set forth for illustrative purposes and are not intended to limit the spirit and scope of the invention. One having skill in the art will recognize that deviations from the aforementioned examples can be created which substantially perform the same functions and obtain similar results.

What is claimed is:

1. An antenna system, comprising:

a wireless communication device including a housing portion, the housing portion enclosing electronic components of the wireless communication device;

a first antenna radiating structure disposed within the housing of the wireless communication device;

a second antenna radiating structure disposed within the housing of the wireless communication device;

a cover accessory removably attached to the housing of the wireless communication device, wherein the cover accessory overlaps with a portion of the housing;

characterized in that the antenna system further comprises:

three conductive elements each embedded within a volume of the cover accessory, at least one active component embedded within the volume of the cover accessory, wherein each of the three conductive elements is positioned to be in proximity with at least one of the first and second antenna radiating structures when the cover accessory is attached to the housing of the wireless communication device; and wherein the at least one active component is coupled to at least one of the three conductive elements, the at least one active component is configured to vary a reactance of the at least one conductive element for tuning a response of the antenna system.

2. The antenna system of claim 1, further comprising:

a first active component coupled to a first of the three conductive elements, the first active component configured to vary a reactance of the first conductive element for tuning a response of the antenna system.

3. The antenna system of claim 2, further comprising:

a second active component coupled to a second of the three conductive elements, the second active component configured to vary a reactance of the second conductive element for tuning a response of the antenna system.

4. The antenna system of claim 2, further comprising:

a passive component coupled to a second of the three conductive elements, the passive component configured to provide a reactance of the second conductive element for optimizing a response of the antenna system.

5. The antenna system of claim 1, wherein each of the three conductive elements is arranged to overlap with another of the three conductive elements.

6. The antenna system of claim 1, wherein the first antenna radiating structure comprises a cellular band antenna adapted for wireless communication with a cellular network.

7. The antenna system of claim 6, wherein the second antenna radiating structure comprises a frequency modulation (FM) band antenna adapted to receive FM radio signals.

8. The antenna system of claim 7, wherein at least one of the three conductive elements is adapted to be positioned adjacent to the FM band antenna for optimizing the FM band antenna of the antenna system.

9. The antenna system of claim 8, further comprising an active component coupled to the at least one of the three conductive elements positioned adjacent to the FM band antenna, the active component configured to vary a reactance of the at least one conductive element for tuning a response of the FM band antenna of the antenna system.

10. The antenna system of claim 1, wherein the conductive elements of the cover accessory are connected to the antenna radiating structures of the wireless communication device at a connection therebetween.

11. The antenna system of claim 10, the connection comprising a connector port and a connector each configured to be connected upon attaching the cover accessory to the housing of the wireless device.

12. The antenna system of claim 11, wherein the cover accessory further comprises a fourth conductive element.

13. An antenna system, comprising:

a wireless communication device including a housing portion, the housing portion enclosing electronic components of the wireless communication device;

a first antenna radiating structure disposed within the housing of the wireless communication device;

a second antenna radiating structure disposed within the housing of the wireless communication device;

a cover accessory removably attached to the housing of the wireless communication device, wherein the cover accessory overlaps with a portion of the housing;

characterized in that the antenna system further comprises:

a first conductive element and a second conductive element, each of the first and second conductive elements embedded within a volume of the cover accessory, at least one active component embedded within the volume of the cover accessory, wherein the first conductive element is positioned to be in proximity with the first antenna radiating structure when the cover accessory is attached to the housing of the wireless communication device;

wherein the second conductive element is positioned to be in proximity with the second antenna radiating structure when the cover accessory is attached to the housing of the wireless communication device;

wherein the at least one active component is coupled to at least one of the first and second conductive elements, the at least one active component is configured to vary a reactance of the at least one the first and second conductive elements for tuning a response of the antenna system.

14. The antenna system of claim 13, further comprising:

a first active component coupled to the first conductive element, the first active component configured to vary a reactance of the first conductive element for tuning a response of the antenna system.

15. The antenna system of claim 14, further comprising:

a second active component coupled to the second conductive element, the second active component configured to vary a reactance of the second conductive element for tuning a response of the antenna system.

16. The antenna system of claim 14, further comprising:

a passive component coupled to the second conductive element, the passive component configured to provide a reactance of the second conductive element for optimizing a response of the antenna system.

17. The antenna system of claim 13, wherein the first antenna radiating structure comprises a cellular band antenna adapted for wireless communication with a cellular network.

18. The antenna system of claim 17, wherein the second antenna radiating structure comprises a frequency modulation (FM) band antenna adapted to receive FM radio signals.

* * * * *